US011959479B1

(12) United States Patent
Alsubaih

(10) Patent No.: US 11,959,479 B1
(45) Date of Patent: Apr. 16, 2024

(54) RADIAL VANE ROTARY COMPRESSOR

(71) Applicant: Adel K Alsubaih, Kuwait (KW)

(72) Inventor: Adel K Alsubaih, Kuwait (KW)

( * ) Notice: Subject to any disclaimer, the term of this patent is extended or adjusted under 35 U.S.C. 154(b) by 0 days.

(21) Appl. No.: 18/218,493

(22) Filed: Jul. 5, 2023

(51) Int. Cl.

| | |
|---|---|
| ***F04C 29/12*** | (2006.01) |
| ***F04C 18/32*** | (2006.01) |
| ***F04C 18/34*** | (2006.01) |
| ***F04C 29/00*** | (2006.01) |

(52) U.S. Cl.
CPC ..... *F04C 18/321* (2013.01); *F04C 29/0057* (2013.01); *F04C 29/12* (2013.01); *F04C 2240/30* (2013.01)

(58) Field of Classification Search
CPC .... F04C 18/321; F04C 18/322; F04C 18/324; F04C 18/344; F04C 29/0057; F04C 29/12; F04C 18/346
See application file for complete search history.

(56) References Cited

U.S. PATENT DOCUMENTS 1,321,706 A * 11/1919 Bosch ..... F04C 18/344 418/238
2,470,656 A * 5/1949 Shorrock ..... F04C 18/344 418/179
4,804,317 A * 2/1989 Smart ..... F01C 21/0809 418/152

FOREIGN PATENT DOCUMENTS

WO WO-2007098595 A1 * 9/2007 ..... F01C 21/0836

OTHER PUBLICATIONS

English WO2007098595 by PE2E Oct. 27, 2023.*

* cited by examiner

*Primary Examiner* — Deming Wan
(74) *Attorney, Agent, or Firm* — Sam Pierce

(57) ABSTRACT

A radial vane rotary compressor comprising a cylindrical casing with multiple independent vanes mounted radially on a centrally fixed shaft in the casing. An offset rotating cylindrical rotor (acts as a slider crank mechanism with each vane) drives the vanes, each with pairs of cylindrical slider segments to allow for sealed sliding and rotation of the vanes with respect to the rotor. The casing internal cylindrical wall is undercut slightly to allow for sufficient sealing aria of contact with the cylindrical rotor to separate intake port from discharge port.

6 Claims, 8 Drawing Sheets

RADIAL VANE ROTARY COMPRESSOR

BACKGROUND

1. Field of the Invention

The present invention relates generally to compressors, and more specifically to a radial vane rotary compressor.

2. Description of Related Art

A compressor is a mechanical device that increases the pressure of a gas by reducing its volume. An air compressor is a specific type of gas compressor. Gas compressors are used in various applications where either higher pressures or lower volumes of gas are needed A positive displacement compressor is one that operates by drawing in a discrete volume of gas from its inlet and then forcing that gas to exit via the compressor's outlet. The gas's pressure increase is due, at least in part, to the compressor pumping it at a mass flow rate that cannot pass through the outlet at the lower pressure and density of the inlet.

Rotary vane compressors are a kind of positive displacement compressors that consist of a rotor with a number of blades inserted in radial slots in the rotor. The rotor is mounted offset in a larger housing that is either circular or a more complex shape. As the rotor turns, blades slide in and out of the slots keeping contact with the outer wall of the housing, to create a series of increasing and decreasing volumes by the rotating blades.

Rotary vane compressors consist of a cylindrical casing, two openings, one suction, and one discharge, and a rotor positioned eccentrically with respect to the casing. Compression occurs by refrigerant flowing into the chamber where, due to eccentric rotation, there is a reduction in the desired volume.

The main disadvantage of the traditional rotary vane compressor is that mechanical friction between the vane tip and cylinder is very high. The power consumption of mechanical friction accounts for 29.1% of the total power.

Accordingly, although great strides have been made in the area of compressors, many shortcomings remain.

DESCRIPTION OF THE DRAWINGS

The novel features believed characteristic of the embodiments of the present application is set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
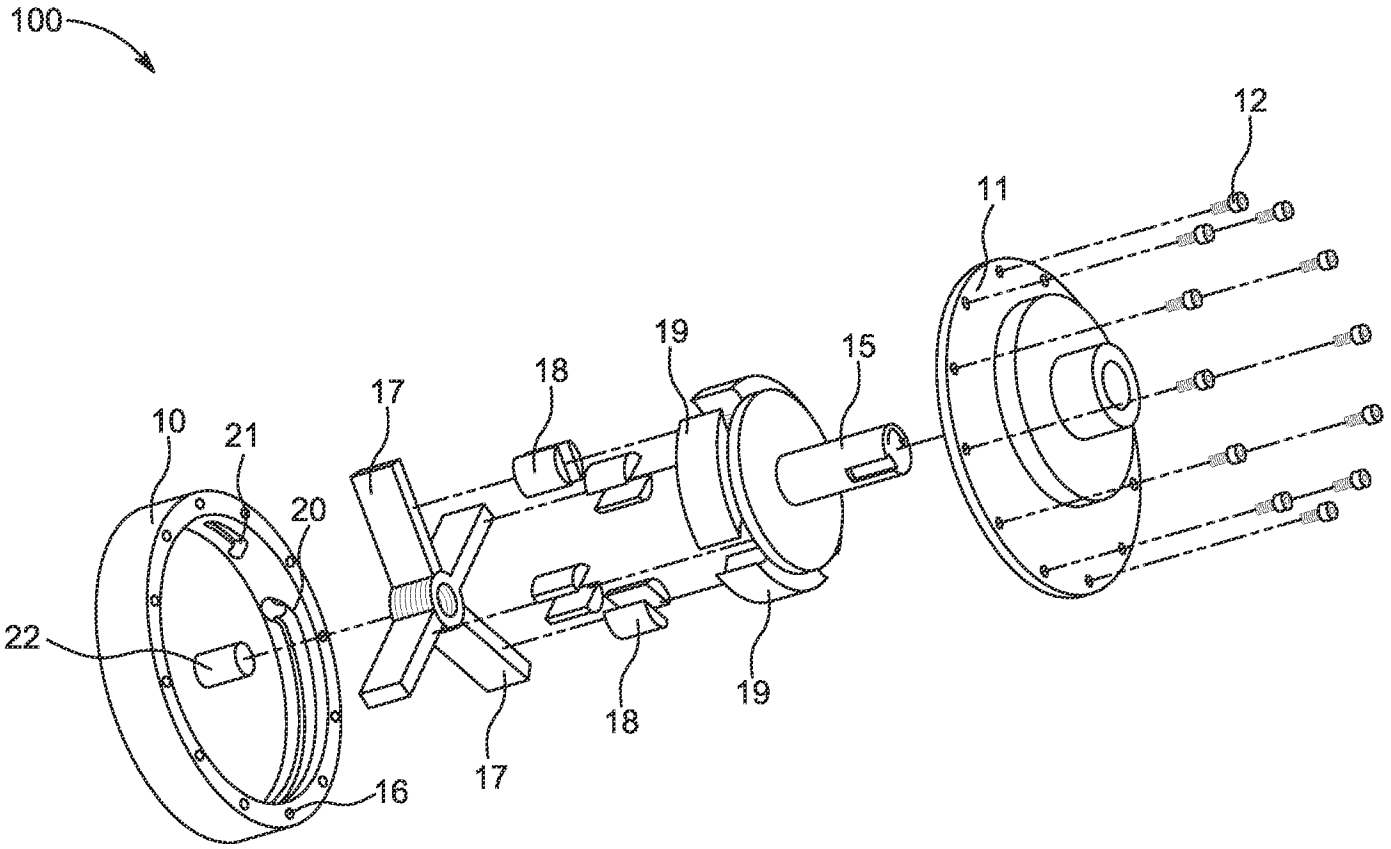
FIG. 1 is an exploded top perspective view of the radial vane rotary compressor showing the inner slots.
Figure 2:
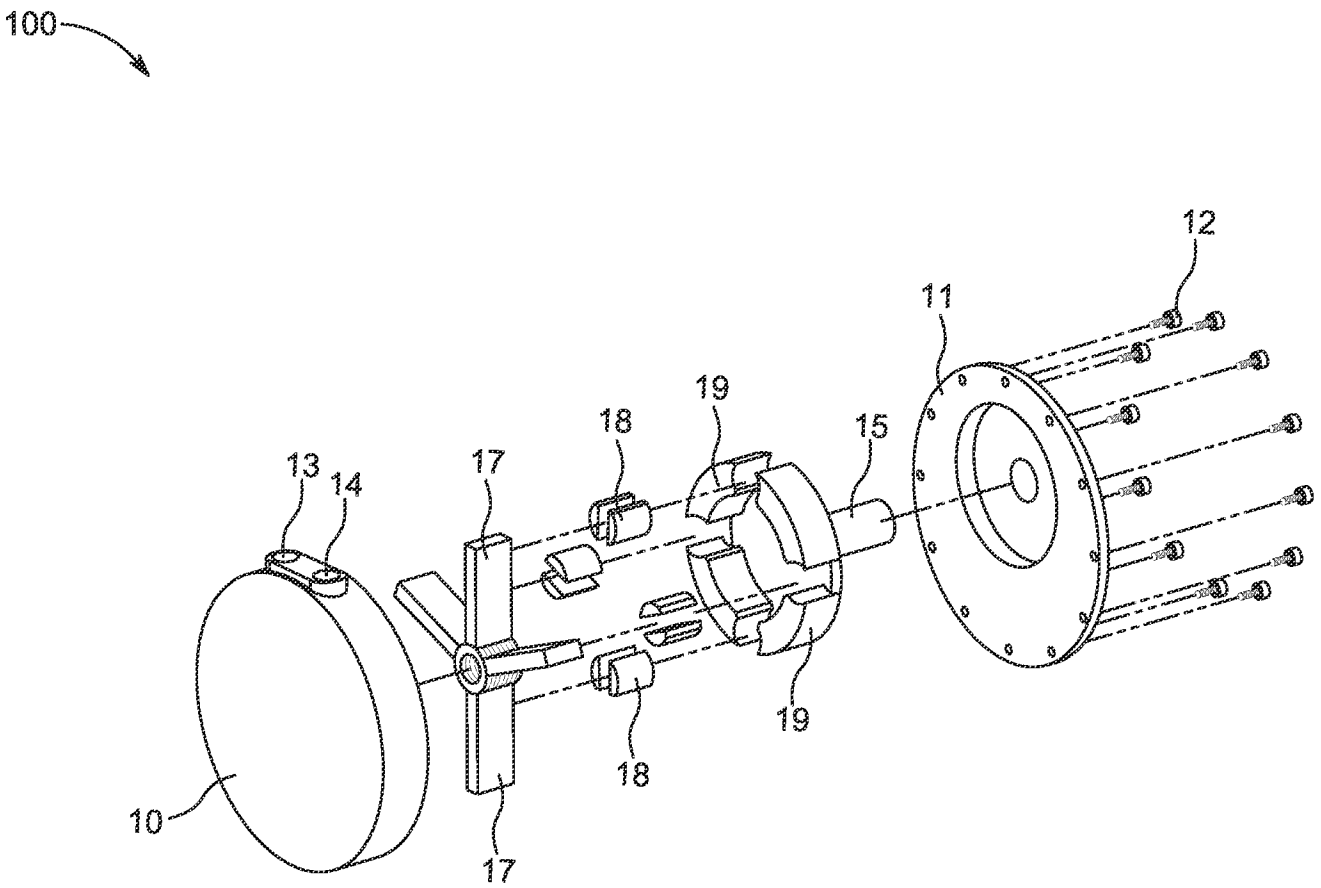
FIG. 2 is an exploded bottom perspective view of the radial vane rotary compressor showing the inner slots.
Figure 3:
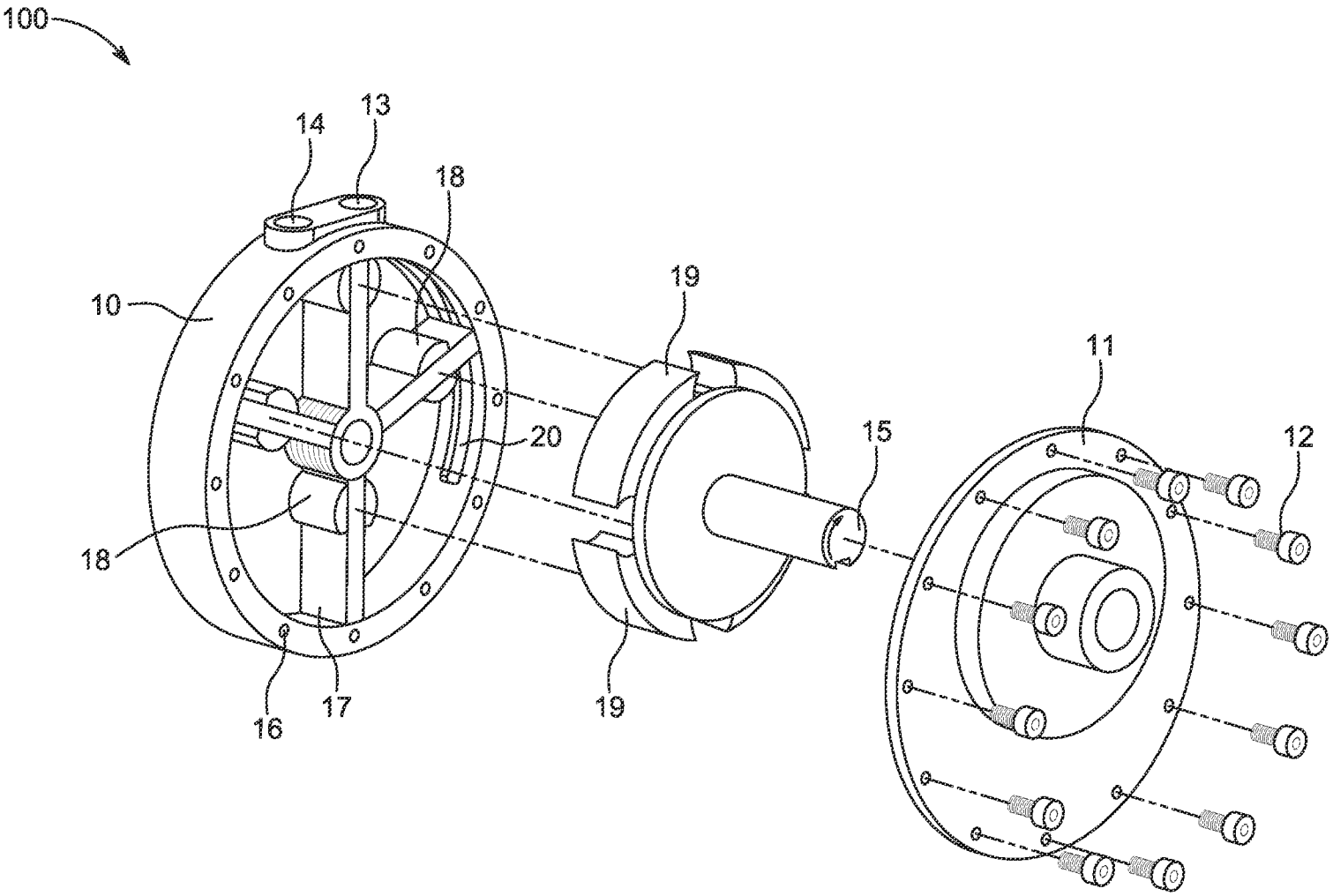
FIG. 3 is a perspective view of the partially assembled radial vane rotary compressor casing of the vane compressor, showing how the vanes and sealing segments fit into the casing.
Figure 4:
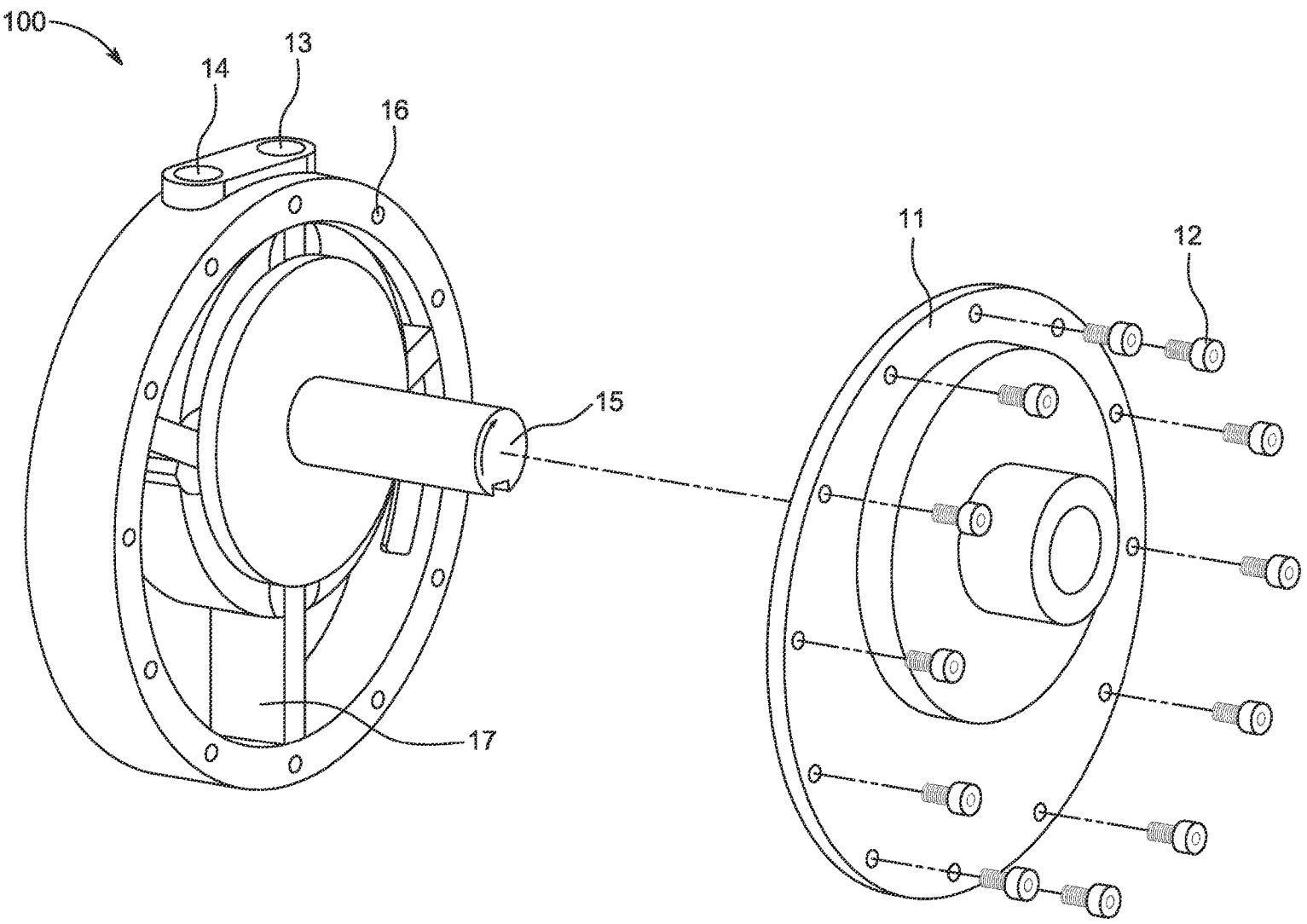
FIG. 4 is a perspective view of the uncovered assembled radial vane rotary compressor, without the cover.

While the radial vane rotary compressor and method of use of the present application are susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the radial vane rotary compressor and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The radial vane rotary compressor and method of use in accordance with the present application overcomes one or more of the above-discussed problems commonly associated with conventional compressors. Specifically, the radial vane rotary compressor of the present invention is more efficient and ideal for small and quiet applications, such as in the automotive and agricultural industries.

These and other unique features of the system and method of use are discussed below and illustrated in the accompanying drawings.

The radial vane rotary compressor and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate unless described otherwise.

A radial vane rotary compressor according to exemplary embodiments of the present invention is described in more detail with reference to the accompanying drawings. In the description, the size of some components illustrated in the drawings may be exaggerated for the convenience of description and clarity.

In addition, terms to be described later are terms defined in consideration of the functions of the present invention, and these may vary with the intention or practice of a user or an operator. Therefore, such terms should be defined based on the entire content disclosed herein.

In addition, the following embodiments are for the purpose of describing the components set forth in the appended claims only and are not intended to limit the spirit and scope of the invention. More particularly, various variations and modifications are possible in concrete constituent elements of the embodiments, and it is to be understood that differences relevant to the variations and modifications fall within the spirit and scope of the present disclosure defined in the appended claims.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein reference characters identify corresponding or similar elements throughout the several views, FIGS. 1-8 depict a radial vane rotary compressor in accordance with a preferred embodiment of the present application. It will be appreciated that radial vane rotary compressor 100 overcomes one or more of the above-listed problems commonly associated with conventional compressors. In addition, it should be appreciated that more or fewer of such components may be included in different embodiments of the radial vane rotary compressor 100.

As shown in FIGS. 1-4, the radial vane rotary compressor 100 according to an embodiment of the present invention includes a casing 10 in which a central shaft 22 is fixed. A plurality of vanes 17 are mesh mounted on the shaft 22 and rotate independently to each other. An offset cylindrical rotor 19 with a plurality of equally spaced cylindrical cuts for the vanes is fitted into the casing 10 with cylindrical sealing segments 18 that allow for sealed rotation and sliding of the plurality of vanes 17. The casing is sealed with a cover plate 11 mounted with a plurality of bolts 12 fitted into a plurality of holes 16. The rotor 19 is coupled to a drive-through shaft 15.

Figure 5:
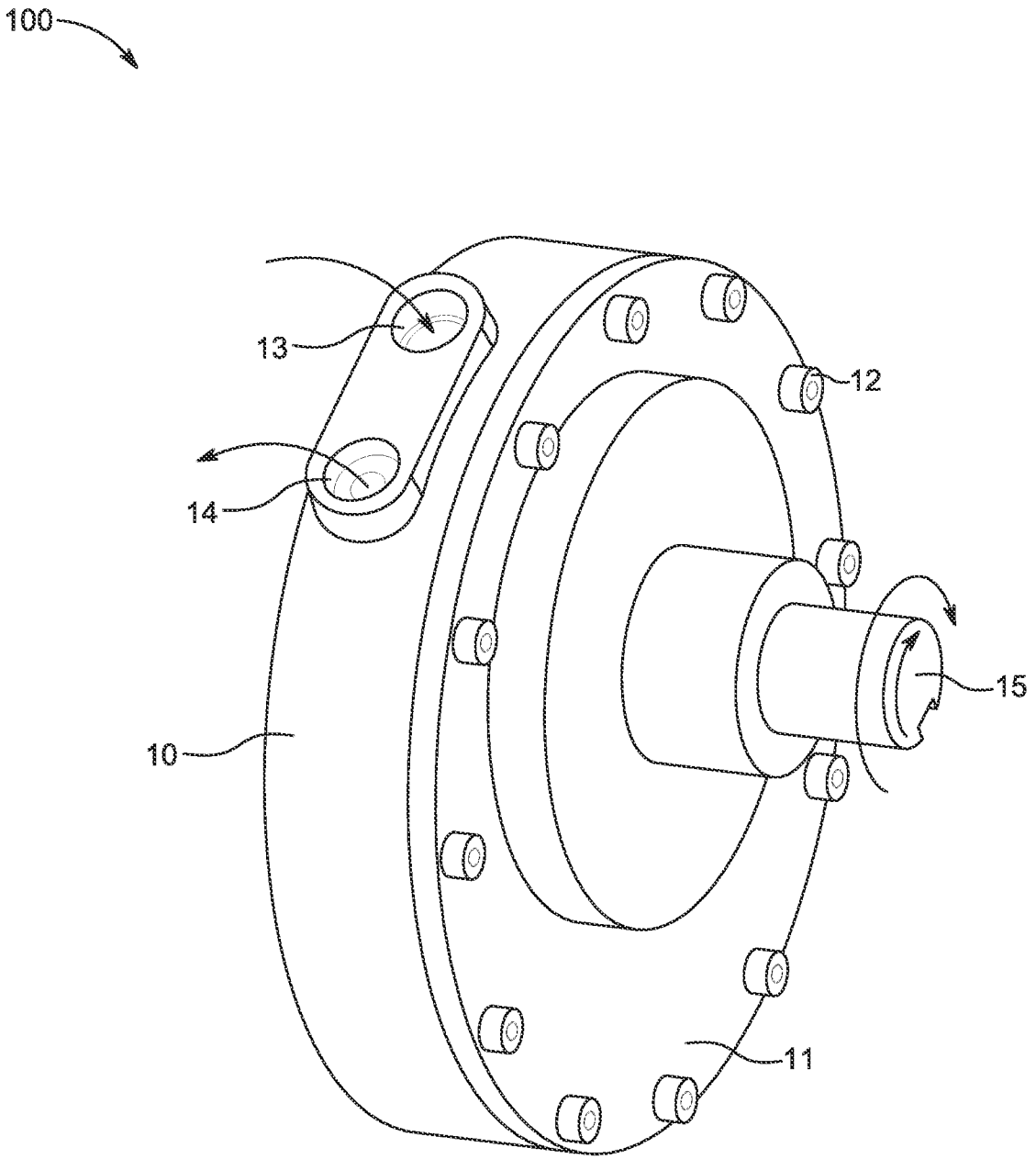
FIG. 5 is a perspective view of the fully assembled radial vane rotary compressor.
Figure 8:
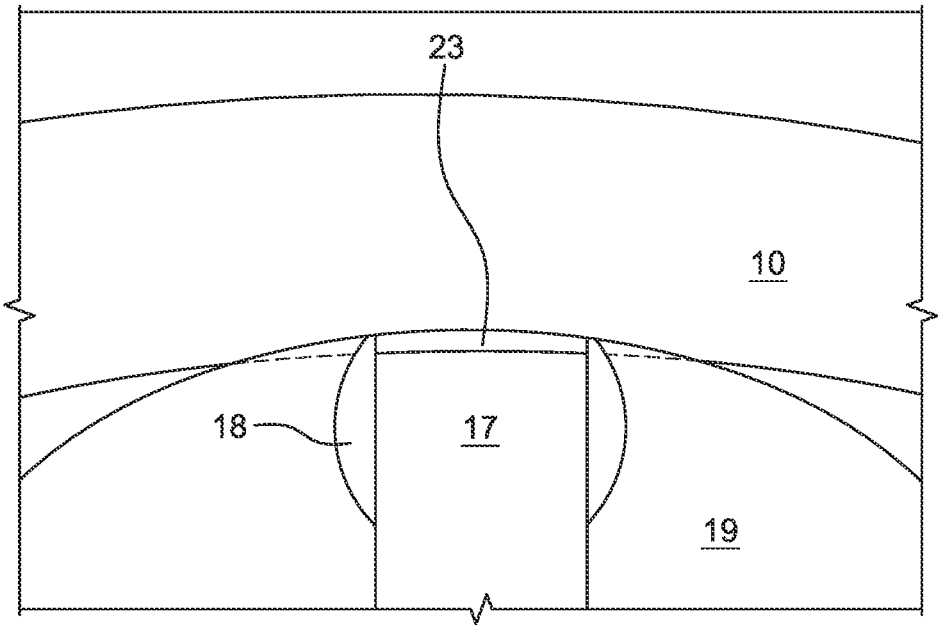
FIG. 8 is an enlarged view of the undercut seal with respect to the internal rotor.

The casing 10 has two openings, an opening for discharge 14 and an opening for suction intake 13 as shown in FIG. 5. The casing internal cylindrical wall, between the intake and discharge openings, is slightly under cut 23, long enough to have a sealing contact area between the body of the rotor 19 and the casing 10, as the plurality of vanes 17 pass over it, as shown in FIG. 8.

Figure 6:
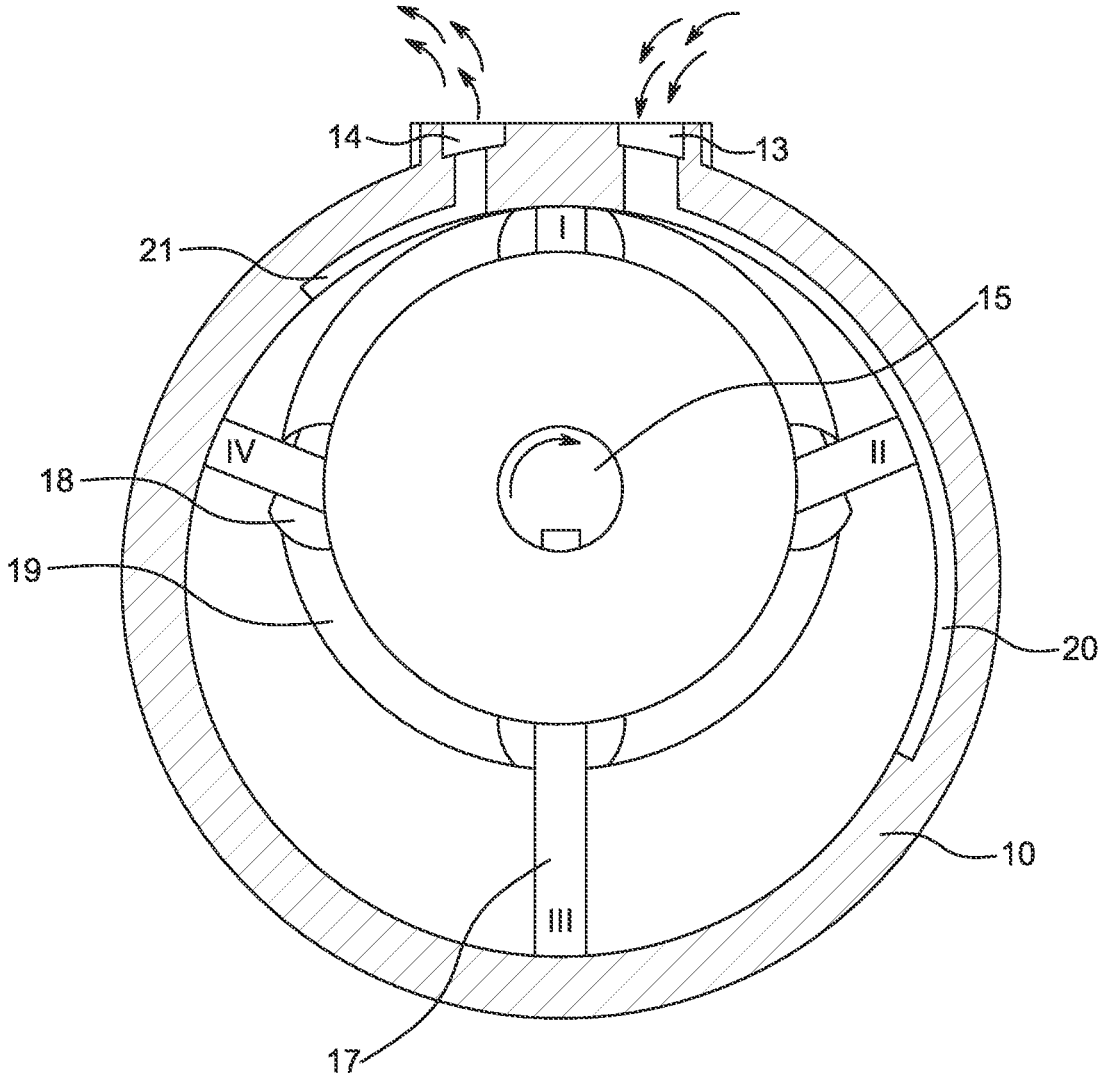
FIG. 6 is a sectional view showing the chamber at its extreme position.
Figure 7:
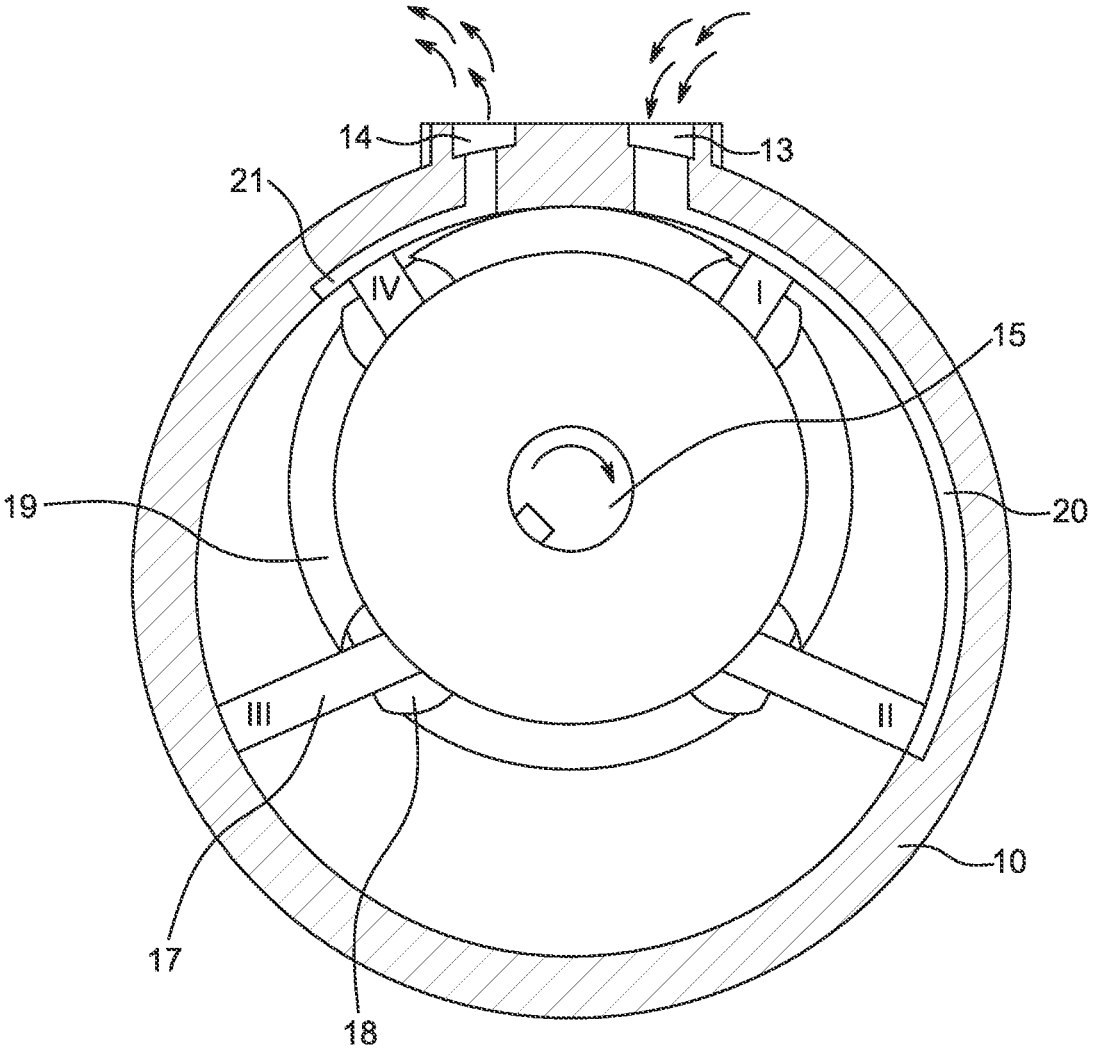
FIG. 7 is a sectional view showing the chamber at its undercut location.

The radial vane rotary compressor 100 of the present invention can have a plurality of vanes 17, but in this embodiment, a four-vane compressor is explained in operation. The fluid in any instant will be sealed in a volume-varying chamber bounded by the casing 10, the rotor 19, the cover plate 11, the vanes 17, and the cylindrical segments 18. As the rotor rotates clockwise, for example, driven by an external drive through shaft 15, the chamber bounded by vanes I and II, as shown in FIG. 6, will be in the intake stage, where fluid enters from the opening 13 through the inner slot 20 filling the sealed cavity. Chamber bounded by vanes II and III, as shown in FIG. 7 is fully sealed and as it rotates will compress the fluid. Chamber bounded by vanes III and IV will have compressed fluid and will discharge through opening 14. The inner slot 21 is designed long enough to optimize the operation.

The radial vane rotary compressor 100 of the present invention has an offset cylindrical rotor with sealed slider segments, that are formed together with each vane in an inverted slider crank mechanism. As the rotor rotates, it will crank each vane at a cyclically variable rotational speed that is off-phase with the others, so that any chamber formed by any two consecutive vanes will expand in volume to the maximum and contract to the minimum for each full rotation. The offset cylindrical slider crank can have cylindrical slider segments in pairs to form a perfect cylinder with the vane wall thickness to allow for sealed sliding and rotation. The rotating cylindrical rotor (acts as a slider crank mechanism with each vane) drives the vanes, each with pairs of cylindrical slider segments to allow for sealed sliding and rotation of the vanes with respect to the rotor.

The radial vane rotary compressor 100 of the present invention can be driven by suitable external means including but not limited to a motor or belt drive or any other suitable driving means. The radial vane rotary compressor can be integrated into a hermetically sealed compressor.

The radial vane rotary compressor 100 of the present invention may have multiple casings with one drive shaft for bigger volumes or for multistage operation.

The radial vane rotary compressor 100 of the present invention may be used as a compressor, pump, metering pump, fluid meter, internal combustion, pressured air/gas/liquid motor . . . etc.

It should be appreciated that the radial vane rotary compressor 100 of the present invention can create a very good suction vacuum, is suitable for continuous air supply, and can achieve high-pressure and high-power compression. The rotary vane compressor 100 has a longer life and can be suitable for medium-pressure applications.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A radial vane rotary compressor comprising:

a cylindrical casing with a fixed shaft at its center, intake and discharge ports, and slight undercut between the intake and discharge ports, wherein the undercut is made semi-tangent to rotor radius;

a plurality of vanes radially mesh mounted on the fixed shaft to form multiple chambers with walls of the said casing;

an offset cylindrical rotor assembly semi-tangent to the casing and rotating within the undercut in the casing inner body to seal between the intake and discharge ports, wherein said offset cylindrical rotor assembly has a plurality of equally spaced cylindrical cuts equal to the number of vanes and coupled to a drive-through shaft;

a plurality of pairs of sealing cylindrical segments;

a plurality of bolts;

a cover plate;

wherein the plurality of vanes is driven by the offset cylindrical rotor assembly; wherein the plurality of vanes pass through the cylindrical cuts of the offset cylindrical rotor assembly with said sealing cylindrical segments to allow for sealed sliding and rotation of the said vanes with respect to the offset cylindrical rotor assembly;

wherein the cover plate is mounted on the cylindrical casing to seal the multiple chambers, and the offset cylindrical rotor assembly, using a plurality of said bolts;

wherein the cylindrical casing has the intake and discharge ports with an appropriate inner extended slot for fluid flow.

2. The radial vane rotary compressor according to claim 1, wherein the cylindrical casing has the slight undercut to the rotor radius, between the intake and discharge ports to form a sealing surface, long enough to maintain a seal while the offset cylindrical rotor assembly and the vanes pass through it without leakage.

3. The radial vane rotary compressor according to claim 1, wherein the offset cylindrical rotor assembly has the radially mounted vanes with a cylindrical profile at its ends, mesh mounted on the fixed shaft with concentric profile ends with minimal clearance with the cylindrical casing, forming a good sealing surface with minimum contact.

4. The radial vane rotary compressor according to claim 1, wherein, as the offset cylindrical rotor rotates, it cranks each of the plurality of vanes so that any of the chambers formed by any two of the consecutive vanes will expand in volume to the maximum (intake) and then contract to the minimum (discharge, compression) for each full rotation.

5. The radial vane rotary compressor according to claim 1, wherein the cylindrical casing can have multiple casings for higher capacity or for multistage operation.

6. The radial vane rotary compressor according to claim 1, wherein the offset cylindrical rotor can be used as one or more of a compressor, pump, metering pump, fluid meter, internal combustion, pressured air/gas/liquid motor.

* * * * *